US008441215B1

(12) United States Patent
Howell

(10) Patent No.: US 8,441,215 B1
(45) Date of Patent: May 14, 2013

(54) TIME BASED HIGH INTENSITY DISCHARGE LAMP CONTROL

(75) Inventor: Brian Rodney Howell, Blackburn (AU)

(73) Assignee: The Active Reactor Company, Pty, Kew, Victoria (AU)

( * ) Notice: Subject to any disclaimer, the term of this patent is extended or adjusted under 35 U.S.C. 154(b) by 517 days.

(21) Appl. No.: 12/722,480

(22) Filed: Mar. 11, 2010

Related U.S. Application Data

(66) Substitute for application No. 61/172,166, filed on Apr. 23, 2009.

(60) Provisional application No. 61/159,602, filed on Mar. 12, 2009.

(51) Int. Cl.
*H05B 37/00* (2006.01)

(52) U.S. Cl.
USPC ..... 315/318; 315/360; 315/312; 315/291; 315/297

(58) Field of Classification Search ..... 315/291, 315/297, 307, 276, 247, 209 R, 312, 318, 315/360, 294; 702/81, 82, 84, 182; 445/3
See application file for complete search history.

(56) References Cited

U.S. PATENT DOCUMENTS

| | | | | |
|---|---|---|---|---|
| 6,084,351 | A * | 7/2000 | Kai et al. | 313/634 |
| 7,385,360 | B2 * | 6/2008 | Dluzniak | 315/307 |
| 7,405,523 | B2 * | 7/2008 | Wilhelm et al. | 315/291 |
| 7,797,117 | B1 * | 9/2010 | Gordin | 702/81 |
| 8,164,269 | B2 * | 4/2012 | Fukuda et al. | 315/247 |

* cited by examiner

*Primary Examiner* — Haiss Philogene
(74) *Attorney, Agent, or Firm* — Inskeep IP Group, Inc.

(57) ABSTRACT

Apparatus and a method for operating high intensity discharge (HID) lamps at a predetermined substantially constant luminous flux output. A power-time characteristic is developed using a test lamp of similar type and rating to the HID lamps. This characteristic defines the power required at different times, which may be regularly spaced intervals of for example 20 hours, during the operating life of the HID lamps to operate the lamps at the predetermined luminous flux output. The power time characteristic is then "played back" in real time via a microprocessor based master controller for the HID lamps. The communications to the HID lamps may be wireless or hard wired. The result is that the HID lamps are operated at substantially constant lumens resulting in significant energy savings and improved lamp performance.

14 Claims, 6 Drawing Sheets

59 61 57

| Time Inverval | Time | Power Code |
|---|---|---|
| 0 | 0 hours | 00 |
| 1 | 20 hours | 01 |
| 2 | 40 hours | 02 |
| 3 | 60 hours | 02 |
| ⋮ | ⋮ | ⋮ |
| 255 | 5100 hours | 60 |

55

Figure 5

57 65

| Power Code | Current |
|---|---|
| 00 | 4.98 Amp |
| 01 | 5.07 Amp |
| 02 | 5.23 Amp |
| 03 | 5.33 Amp |
| ⋮ | ⋮ |
| 63 | 6.55 Amp |

63

Figure 6

TIME BASED HIGH INTENSITY DISCHARGE LAMP CONTROL

RELATED APPLICATIONS

This application claims priority to U.S. Provisional Application Ser. No. 61/159,602 filed Mar. 12, 2009 entitled Time Based High Intensity Discharge Lamp Control, and to U.S. Provisional Application Ser. No. 61/172,166 filed Apr. 23, 2009 entitled Time Based High Intensity Discharge Lamp Control, both of which are hereby incorporated herein by reference.

FIELD OF THE INVENTION

The present invention relates to methods, systems and controllers for operating high intensity discharge (HID) lamps at a substantially constant luminous flux output.

BACKGROUND OF THE INVENTION

HID lamps include high pressure sodium lamps, metal halide lamps and mercury vapour lamps. They are typically used in areas such as sports stadiums, warehouses and large public areas, where high levels of light over large areas are required. HID lamps tend to have relatively high power ratings, for example above 150 Watts. They tend to operate under higher pressures and temperatures than fluorescent lamps.

Generally, a HID lamp system will use an inductive ballast that is designed to make the lamp operate at its approximate design power. When operated this way, the luminous flux output from the lamp is not constant and deteriorates over time. A lamp may lose up to one half of its light producing capacity by the end of its operating life.

In situations where a specified constant level of light is required, for example in sports stadiums, this means that either 1) the lamp needs to be replaced once its luminous flux output decreases below the specified level, or 2) additional lamps need to be installed to ensure that the particular level of light is achieved, despite deterioration in the luminous flux output from the lamp. Both options result in a higher cost of the lighting system. Also, in the first case, some of the operating life of the lamp may be wasted, and in the second case, higher energy use may be required.

It would be desirable to provide a method of operating HID lamps, and apparatus for performing the method, that ameliorates the effects of lamp deterioration.

OBJECTS AND SUMMARY OF THE INVENTION

According to one aspect, the present invention provides a method for operating one or more high intensity discharge (HID) lamps of a particular type and rating, and having a defined operating life, at a predetermined substantially constant luminous flux output, the method including the steps of:

(i) using a test lamp of a similar type and rating to the HID lamps to develop a power-time characteristic that defines the power required at different times in the operating life of the lamps to operate the lamps at the predetermined luminous flux output, and (ii) operating the HID lamps in accordance with the power-time characteristic.

Using the method, a HID lamp may be operated at a constant luminous flux output throughout its operating life, thereby ameliorating the light depreciation problem of lamp deterioration. The method results in a longer useful life of the lamp, and a more stable light output from the lamp. A lighting system using the present invention may therefore provide cost and energy savings.

The power-time characteristic developed using the test lamp is specific to HID lamps of similar type and rating to the test lamp. For example, the type of HID lamp may be metal halide (MH) or high pressure sodium (HPS) and the rating may be between 150 W and 2000 W. Separate power-time characteristics may be developed for HID lamps of different types and ratings.

The predetermined substantially constant luminous flux output may be tailored for the circumstances in which the lamps will be used. For example, a desired luminous flux output for a 1500 W metal halide lamp for use in sports lighting may be 145,000 lumens. The operating life of such a lamp is around 5000 hours.

Using a test lamp to develop a power-time characteristic may include the steps of:

(a) at a plurality of different times in the operating life of the test lamp:

(i) measuring a luminous flux output from the test lamp, and (b) if the luminous flux output differs from the predetermined luminous flux, (ii) altering power to the test lamp until its luminous flux output equals the predetermined luminous flux, and (iii) recording the time of alteration and the amount of power required at that time, whereby to develop the power-time characteristic.

The power-time characteristic may be a graph of power vs time over the operating life of the test lamp, or it may be a table of values of power required at the plurality of different times in which data is recorded. It may alternatively be a list of codes associated with operating times, the codes representing the amount of power required at each time. In this case, recording the amount of power required involves recording a code representing the amount.

The power required may be an amount of power increase or decrease, a total power needed or an amount of power to be injected, for example, by a current injector or secondary ballast. The characteristic may be developed using one test lamp, or using multiple test lamps and taking an average or some other statistical measure of the lamp power.

Altering power to the test lamp may involve increasing or decreasing current to the test lamp. In this case, recording the amount of power required may involve recording the amount of current required. The record of current vs time may form the power-time characteristic, or the power required may be determined using the current and the voltage of the power supply.

The steps of altering power and recording time and amount of alteration may be done manually or automatically by hardware or software. For example, the power may be altered manually, and the data recorded automatically.

The plurality of different times at which measurements are made may be equally spaced over the operating life of the test lamp. For example, for a lamp with an operating life of 5000 hours, measurements may be made every 20 hours. Of course, it will be appreciated that measurements could be made more often than this and need not be equally spaced.

A lamp typically experiences its greatest luminous flux depreciation over the first part of its operating life (say for example over the first 1000 hours), then the flux steadily decreases after this time. It may be possible, therefore, to take measurements at intervals up to well into the steadily decreasing portion of the lamp's operating life (say for example up to 2000 hours) such that the recorded data will cover the first part (i.e. the relatively rapidly decreasing luminous flux part) of the lamp's operating life plus sufficient of its remaining operating life (i.e. the steadily decreasing luminous flux part) for the rest of the remaining part to be extrapolated so that the power-time characteristic covers the operating life of the HID lamps.

Operating the HID lamps in accordance with the power-time characteristic may include the steps of:

(a) at a plurality of different times in the operating life of the HID lamps:

(i) altering power to the HID lamps so that they operate at a power corresponding to that time in the power-time characteristic.

The plurality of different times in the operating life of the HID lamps that the power to the lamps is altered may coincide with the plurality of different times in the operating life of the test lamp that measurements were taken. For example, if measurements were taken every 20 hours, the power to the HID lamps may be altered every 20 hours. It will be appreciated, however, that the times need not coincide.

Again, altering the power to the HID lamps may involve increasing or decreasing current to each lamp.

If the control of the lamps is centrally managed, operating the HID lamps may include the steps of:

(a) at a plurality of different times in the operating life of the HID lamps:

(i) communicating a power (for example, an increase or decrease in current) corresponding to that time in the power-time characteristic to controllers of the HID lamps.

If the power is recorded as a code, the method may involve communicating the code representing the amount of power, and then determining the amount of power from the code. This reduces the data that needs to be communicated.

According to a further aspect, the present invention provides a controller for operating a high intensity discharge (HID) lamp of a particular type and rating, and having a defined operating life, at a predetermined substantially constant luminous flux output, the controller including:

(i) a power control unit for electrical connection between a power supply and the lamp, for altering an amount of power supplied to the lamp, and (ii) a timer for recording an amount of time that the lamp has been operating, wherein the power control unit alters the amount of power supplied to the lamp at a plurality of different times in the operating life of the lamp according to a power-time characteristic developed using a test lamp of a similar type and rating to the lamp, the power-time characteristic for operating HID lamps of that type and rating at the predetermined luminous flux output.

A power control unit suitable for use in the present invention may include a primary ballast to provide a primary current to the lamp, and a current injector for injecting a secondary current to the lamp in order to alter the amount of power supplied to the lamp. Such a power control unit is described in International Patent Application PCT/AU2004/000601 to the present applicant, the contents of which are incorporated by reference.

The power control unit may alternatively be a magnetic ballast, or an electronic ballast.

The controller may further include a memory storing the power-time characteristic, and a microprocessor for determining the power required at a given time from the power-time characteristic.

The timer may be an electronic clock with a non-volatile memory that accumulates and stores the total running time of the lamp.

According to another aspect, the present invention provides a system for operating one or more high intensity discharge (HID) lamps of a particular type and rating, and having a defined operating life, at a predetermined substantially constant luminous flux output, the system including:

(a) a slave controller for each HID lamp, each slave controller including:

(i) a power control unit for electrical connection between a power supply and the lamp, for varying the amount of power supplied to the lamp, and (ii) a receiver for receiving communications to the slave controller, and (b) a master controller including:

(i) a timer for recording the amount of time that the HID lamps have been operating, and (ii) a transmitter for transmitting communications to the slave controller, wherein the master controller communicates a power to the slave controllers at a plurality of different times in the operating life of the HID lamps, the power determined according to a power-time characteristic developed using a test lamp of a similar type and rating to the HID lamps, the power-time characteristic for operating HID lamps of that type and rating at the predetermined luminous flux output.

The master controller may include a memory storing the power-time characteristic, and a microprocessor for determining the power required at a given time from the power-time characteristic. If the power-time characteristic is stored as codes indicating the power required at specific operating times, the microprocessor determines the code corresponding to a given time, rather than the power required at the given time.

This information is then communicated to the slave controllers using the transmitter. The communication between the master and slave controllers may be wired, fibre optic, wireless or a combination of these types of communication links.

In the embodiment where codes are transmitted, the slave controller may include a memory storing the amount of power corresponding to codes in the power-time characteristic, and a microprocessor for determining the power required from a code. The slave controller can then run the lamp at the required power.

The master/slave controller system is suitable for situations where a series of lamps are illuminated simultaneously, for example, at a sports stadium. It reduces the cost of the lighting system, as the slave controllers do not need separate timers and memories to store the power-time characteristic.

For a better understanding of the invention and to show how it may be performed, embodiments of the present invention will now be described, by way of example only, with reference to the accompanying drawings.

BRIEF DESCRIPTION OF THE DRAWINGS

FIG. 5 is a table storing a power-time characteristic as power codes corresponding to different time intervals in the operating life of a lamp.

FIG. 6 is a table relating the power codes of FIG. 5 with actual amounts of current to be injected into the lamp.

DESCRIPTION OF EMBODIMENTS

Figure 1:
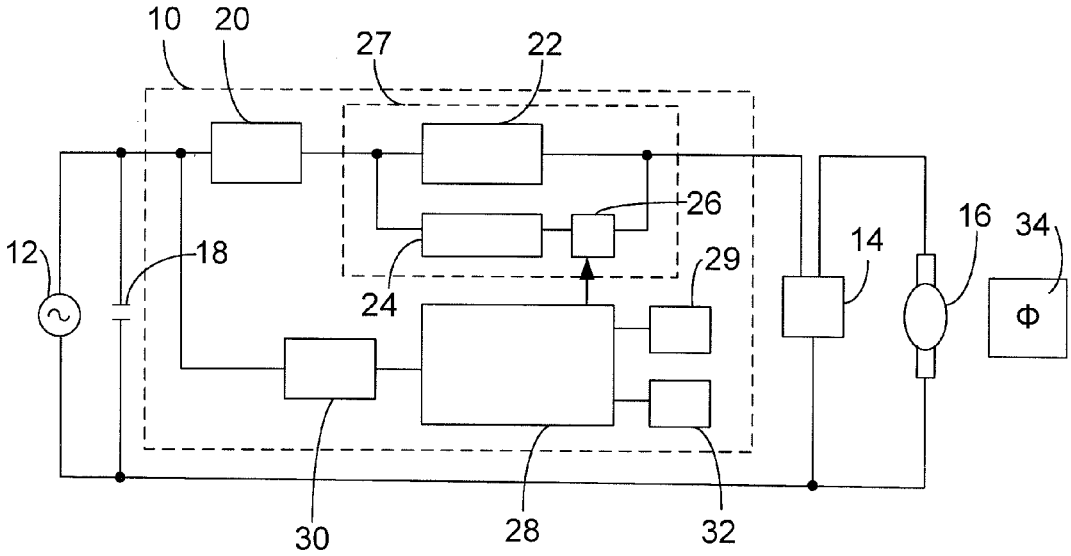
FIG. 1 is a schematic block diagram of a controller and other components to operate a lamp.

Specific embodiments of the invention will now be described with reference to the accompanying drawings. This invention may, however, be embodied in many different forms and should not be construed as limited to the embodiments set forth herein; rather, these embodiments are provided so that this disclosure will be thorough and complete, and will fully convey the scope of the invention to those skilled in the art. The terminology used in the detailed description of the embodiments illustrated in the accompanying drawings is not intended to be limiting of the invention. In the drawings, like numbers refer to like elements.

FIG. 1 shows a schematic block diagram of a controller 10 and other components to operate a HID lamp 16.

An AC power source 12 is placed in circuit with an ignitor 14 and the lamp 16. The circuit also includes a power factor correction capacitor 18 connected across the terminals of the AC power source 12.

The controller 10 shown in this embodiment includes a transformer 20, being a step-up transformer that acts to inject voltage into the lamp circuit to facilitate lamp starting. The transformer 20 is connected in series with the lamp circuit and injects approximately 277 volts AC into the circuit and subsequently into the lamp 16. This aids in starting of the lamp 16, particularly as it ages.

The transformer 20 is electrically connected to a primary ballast 22, which in this embodiment is an inductor. A control ballast 24 and an electronic switch (e.g. a triac) 26 are connected in parallel with the primary ballast 22 as a current injector. The primary ballast 22, control ballast 24 and switch 26 together from a power control unit 27.

When the switch 26 is closed, current flows through the control ballast 24, and the control ballast 24 thereby injects current into the main circuit. The control ballast 24 is switched in a transient fashion, e.g. only for a portion of the duration of a cycle of the AC supply.

A microprocessor 28 controls the switch 26 to inject the additional current into the main circuit. A memory 29 is connected to the microprocessor 28. The microprocessor 28 is operated by a power supply 30, for example, a 5V DC regulated supply. A timer 32 records the amount of time that the lamp 16 has been operating.

Also shown in FIG. 1 is a flux meter 34, for measuring a luminous flux output from the lamp 16. The flux meter 34 may be used with the controller 10 and other components in a method for developing a power-time characteristic for operating lamps of a particular type and rating at a predetermined substantially constant luminous flux output. For this method, the lamp 16 is a test lamp with a similar type and rating. The method is depicted in FIG. 2.

Figure 2:
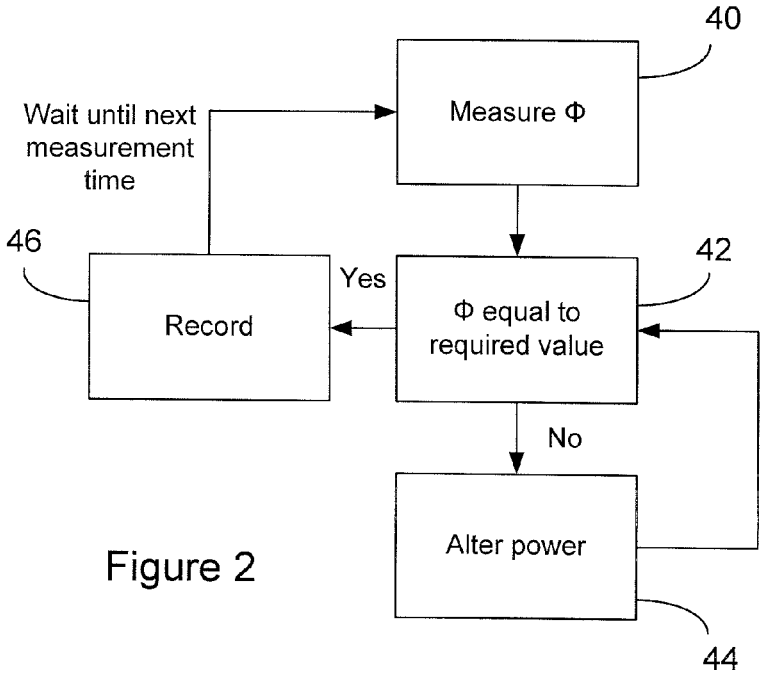
FIG. 2 is a flow chart of a method for developing a power-time characteristic for operating lamps of a particular type and rating at a substantially constant luminous flux output.

Referring to FIG. 2, at step 40 a luminous flux output from the test lamp 16 is measured. The luminous flux output is then compared to the predetermined constant luminous flux output at step 42. If it differs from this constant, the power to the test lamp 16 is altered at step 44. For example, the power may be manually altered by pressing buttons connected to the microprocessor 28, to direct it to close or open the switch 26. This causes the secondary ballast 24 to inject more or less current into the main circuit, thereby increasing or decreasing the lamp power.

The comparing and altering steps 42 and 44 are repeated until the luminous flux output of the test lamp 16 equals the predetermined luminous flux. Then the time of alteration and the amount of power required (for example, the amount of increase or decrease in current) is recorded at step 46, whereby to develop the power-time characteristic. The amount of power required may be recorded as a code representing the amount. The microprocessor 28 may automatically cause the data to be recorded in the memory 29.

Steps 40 to 46 are repeated at a plurality of different times in the operating life of the test lamp 16. These times may be equally spaced, or may be unequally spaced at convenient times to make the measurements.

Figure 3:
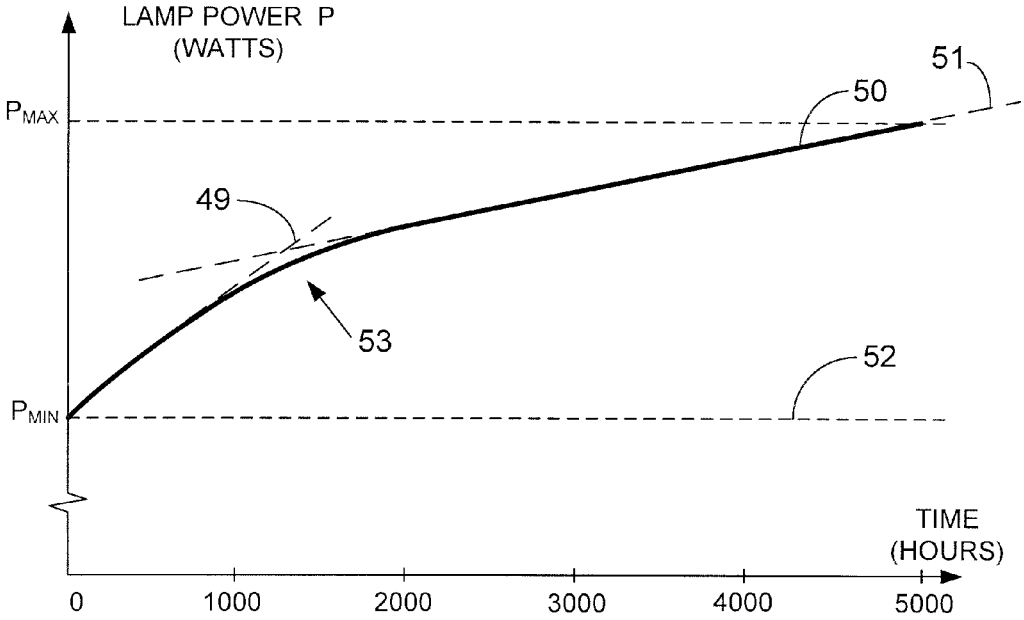
FIG. 3 is a graph of a typical power-time characteristic for a 1500 W metal halide lamp.

FIG. 3 shows a graph of a typical power-time characteristic 50 for operating a 1500 W metal halide lamp at a luminous flux output of 145,000 lumens. To develop this characteristic 50, measurements may be taken every 20 hours and, for example, 250 measurements may be made so that the power-time characteristic covers the operating life of the HID lamps.

It can be seen from the power-time characteristic 50 that the power required to operate the lamp 16 (and other lamps of a similar type and rating) at the predetermined luminous flux output at the start of the lamp's operating life is PMIN=1200 W. The required power increases rapidly for a first part of the operating life of the lamp 16, and then increases steadily before reaching PMAX=1700 W. For some lamps, the rapid increase in required power over a first part of the lamp's operating life may be approximated by a constant gradient as indicated by the line 49, and the steady increase in required power over the remaining operating life of the lamp may be similarly approximated by a constant gradient as indicated by the line 51. If a lamp exhibits this type of power time characteristic for a constant luminous output, it may be possible to develop a power time characteristic for the whole operating life of the lamp by taking measurements that go past the "knee" region 53 of the curve 50 and then extrapolating the remainder of the curve from those measurements.

The power-time characteristic 50 can be used to operate other similar lamps at the predetermined luminous flux output.

In one embodiment, the lamps are each fitted with a controller 10 as shown in FIG. 1, with the power-time characteristic 50 stored in the memory 29. The timer 32 operates when the lamp is switched on to record the amount of time that the lamp has been operating. The primary ballast 22 is chosen to provide power of PMIN to the lamp.

At a plurality of different times in the operating life of the lamp, the microprocessor 28 determines the required power from the power-time characteristic stored in the memory 29. The microprocessor 28 accordingly instructs the switch 26 to open or close, thereby increasing or decreasing the current injected into the main circuit by the secondary ballast 24 such that the required power is supplied to the lamp.

Referring to the graph of FIG. 3, the line 52 shows the power provided by the primary ballast 22, with the difference between the power-time characteristic 50 and the line 52 at a given time being the amount of power to be injected by the secondary ballast 24.

Figure 4:
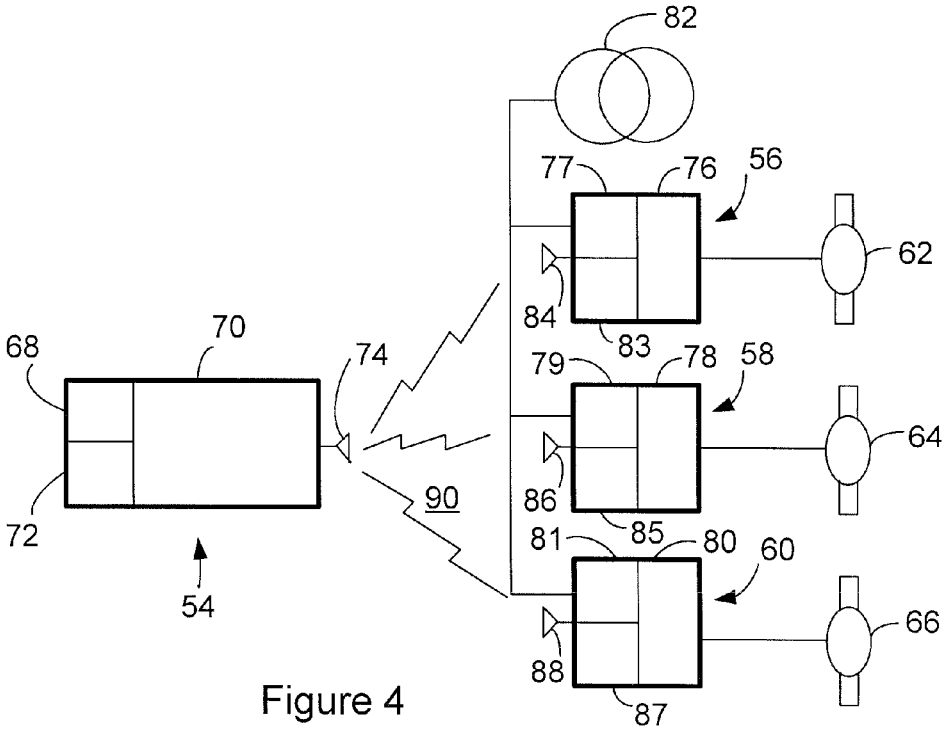
FIG. 4 is a schematic block diagram of a master controller and slave controllers.

In another embodiment, illustrated in FIG. 4, a master controller 54 communicates a required power to slave controllers 56, 58 and 60. Each slave controller 56, 58 and 60 is for operating a lamp 62, 64 and 66 respectively. The lamps 62, 64 and 66 are of a similar type and rating and are operated simultaneously.

The master controller 54 has a memory 68 storing a power-time characteristic developed using a test lamp for lamps of the type and rating of lamps 62, 64 and 66. As shown in FIG. 5, the power-time characteristic in this embodiment is recorded in a look up table 55 as power codes 57 for each time interval 59. In FIG. 5, 255 time intervals 59 are shown, being spaced apart by 20 hours. Each time interval 59 represents a time 61 in the operating life of the lamps. As shown in look up table 55, the same power code may be recorded against different time intervals 59. The master controller 54 also has a microprocessor 70, a timer 72 and a transmitter 74. In this example, the transmitter 74 is an antenna for communicating with the slave controllers 56, 58 and 60.

Each slave controller 56, 58 and 60, has a power control unit 76, 78 and 80, which includes a primary ballast and current injector, as described in relation to FIG. 1. The power control units 76, 78 and 80 are electrically connected between a power supply 82 and the lamps 62, 64 and 66. In this example, a single power supply 82 is used for all of the lamps; however, it is possible to use a separate power supply for each lamp. A switch (not shown) may be included between the power supply 82 and before the slave controller/lamp combinations 56-62, 58-64 and 60-66 for switching on the lamps. When this switch is switched ON, an appropriate signal (e.g. a logical high) may be supplied to the master controller 54 to activate it. When the switch is OFF, the signal to the master controller 54 (e.g. a logical low) renders the master controller 54 inactive. The timer 72 may operate only when the master controller 54 is active, thereby measuring the operating time of the lamps.

In this example, the slave controllers 56, 58 and 60 are programmed with instructions that relate the power codes 57 of FIG. 5 with actual amounts of power 65 (in this case current—see FIG. 6) to be injected into the lamp. On receipt of a power code 57, the microprocessors 83, 85 and 87 operate the power control units 76, 78 and 80 in accordance with these instructions to inject the correct amount of current into the lamps via the secondary ballasts.

In another example, the power codes 57 and corresponding amounts of power 65 could be stored in a look up table 63 (see FIG. 6) in the slave controller memories 77, 79 and 81. In this case, microprocessors 83, 85 and 87 determine the power required 65 from the power code 57 using the information stored in the look up table 63.

The slave controllers 56, 68 and 60 also have receivers 84, 86 and 88 in the form of antennas for receiving communications from the master controller 54 via its antenna 74.

Figure 7:
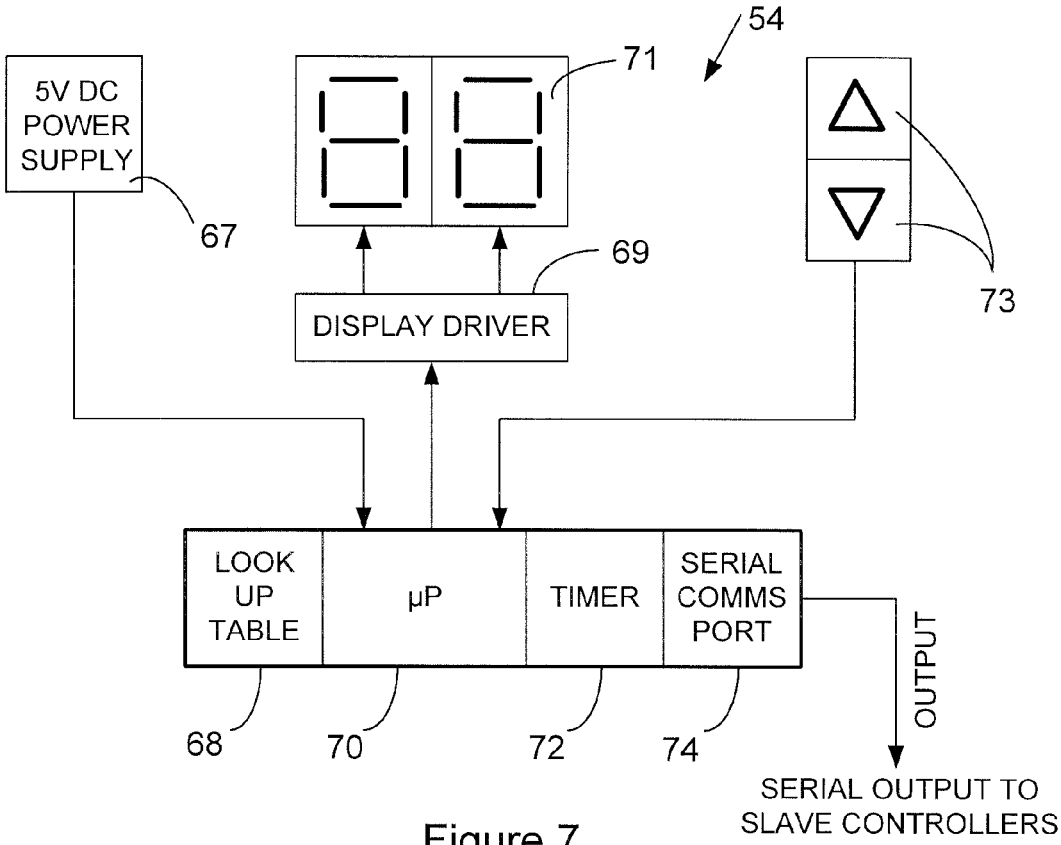
FIG. 7 shows in more detail the components of a master controller for establishing a power-time characteristic.

FIG. 7 shows in more detail the components of the master controller 54. The master controller 54 includes, as previously described, a microprocessor 70, with a memory 68, a timer 72 and a transmitter 74. FIG. 7 illustrates a master controller set up for developing the power time characteristic to be stored in its memory 68 and for operating, via the transmitter 74, slave controllers (such as the slave controllers 56, 58, 60 of FIG. 4) or a test lamp. The transmitter 74 may be a serial communications port. The microprocessor 70 is powered by a suitable supply 67, for example 5V dc, and operates a suitable display 71 via a display driver 69 for indicating time and power during development of the power time characteristic. Linked to the microprocessor 70 is a push button unit 73.

To develop the power time characteristic, an operator, at each say 20 hour measurement point for a test lamp (which time may be displayed by appropriate initial manipulation of a push button—for example a single push of the up button), manipulates the up-down push buttons 73 until the luminous flux output of the test lamp matches the desired constant value (as indicated by a separate flux meter). When the test lamp output is at the desired constant value, appropriate manipulation of a button of the push button unit 73 (for example a rapid double push of the up button) causes the power (and/or code representing the power) and time at that measurement point to be stored in the memory 68. Thus a power time characteristic in the form of a look up table is developed that defines the power required at different times in the operating life of HID lamps (of similar type and rating to the test lamp) for the lamps to give a substantially constant luminous flux output.

Where the master controller records only the power required, the power values may be subsequently converted into codes.

Where the master controller records only a code representing a power, then the appropriate power for that code may be simultaneously communicated to the slave controllers.

The use of codes to represent power means the master controller need only store a look up table 55 (see FIG. 5) showing a power code for each time interval. The slave controllers may then be programmed to convert the codes directly to the relevant power, or alternatively a look up table 63 relating the codes to the power required (see FIG. 6) may be stored in the slave controller memories.

The master controller 54 may then be used to drive slave controllers as illustrated by FIG. 4.

Figure 8:
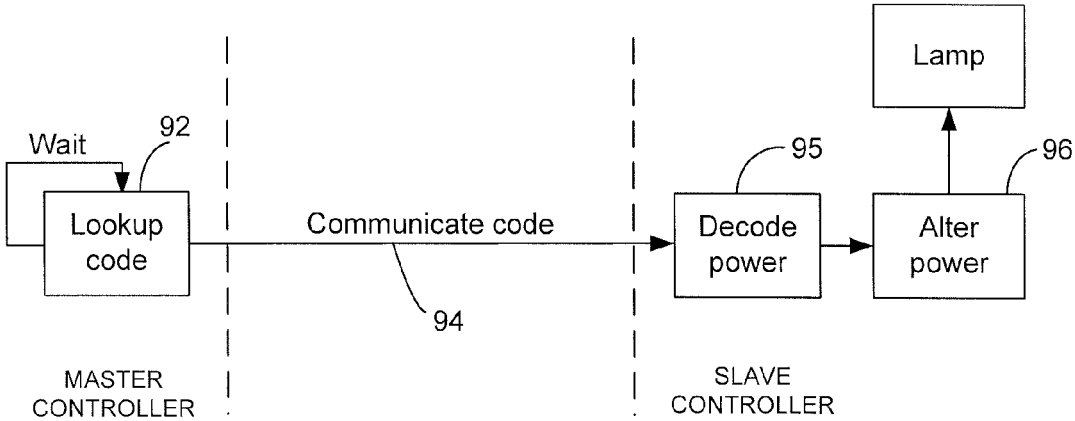
FIG. 8 is a flow chart of a method for operating lamps using a master controller and slave controllers.

FIG. 8 illustrates a method for operating the lamps 62, 64 and 66 using the master controller 54 and slave controllers 56, 58 and 60.

At a plurality of times in the operating life of the lamps 62, 64 and 66, as recorded by the timer 72, the microprocessor 70 looks up the power-time characteristic stored in the memory 68 to determine the power code 57 corresponding to that time interval 59, which represents the power that the lamps should be operating at (step 92). At step 94, using the transmitter 74, the microprocessor 70 communicates this power code 57 to the slave controllers 56, 58 and 60. The communication link 90 is wireless in this case, but could be hardwired in other embodiments. The power code 57 may be transmitted from the master controller 54 to the slave controllers 56, 58 and 60, for example, every 30 seconds. For example, the same code may be transmitted for 20 hours, then the next code for the next 20 hours. This reduces the impact of corrupted transmissions.

The receivers 84, 86 and 88 receive the communication, and at step 95 the microprocessors 83, 85 and 87 look up the memories 77, 79 and 81 to determine the power required 65 from the power code 57. At step 96 the power control units 76, 78 and 80 are operated to alter the power supplied to the lamps 62, 64 and 66 such that the lamps operate at a substantially constant luminous flux output.

While power codes 57 have been transmitted in this embodiment, it will be appreciated that in another embodiment the power required could be directly transmitted from the master controller 54 to the slave controllers 56, 58 and 60.

In a further embodiment, a master controller 54 may control individual lamps separately via their slave controllers. Each slave controller is assigned an address (for example, a 2 digit number) that is used to communicate with that slave controller.

Again, in this embodiment the master controller 54 stores in memory 68 a power-time characteristic that can be used to operate the lamps. Where the lamps are the same, the power-time characteristic may be stored as a single look up table, for example table 55 shown in FIG. 5. Where the lamps are different, separate look up tables storing each characteristic are required.

The master controller 54 may have a separate timer for each lamp, or the timer 72 could be used to measure the operating time of all of the lamps, by keeping a record of the starting time of each lamp.

This embodiment allows for lamps, which may fail prematurely before their end of life, to be replaced and their power-time characteristic reset so that they at all times produce a substantially constant luminous flux output.

Figure 9:
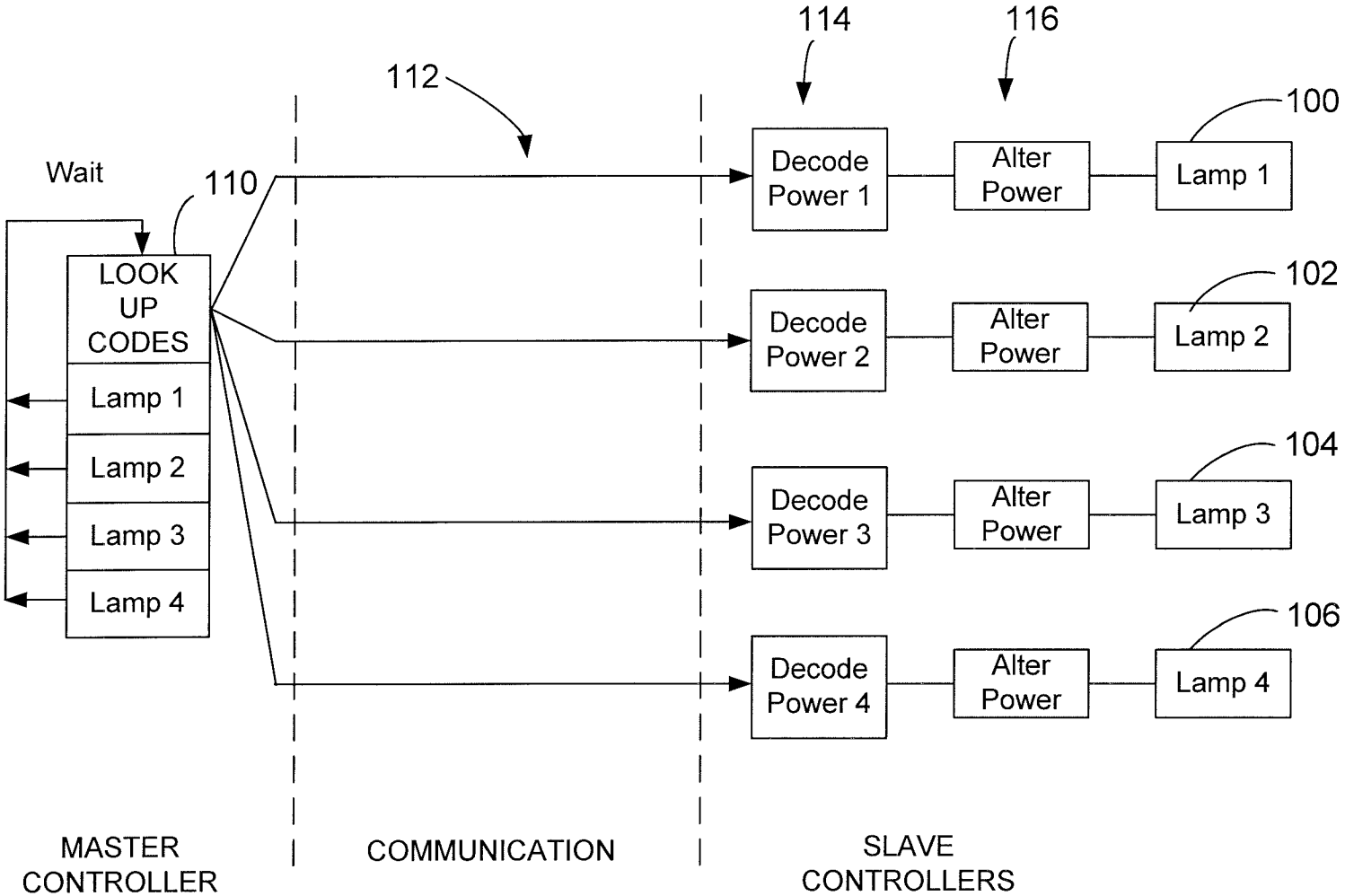
FIG. 9 is a flow chart of a method for operating lamps having different starting times.

With reference to FIG. 9, for each lamp (100, 102, 104 and 106), its time of operation is determined and at step 110, the microprocessor 70 looks up the power-time characteristic (for example table 55) and determines the power code 57 corresponding to that time. This power code 57 and the address code of the lamp are communicated to the slave controllers via the transmitter 74 at step 112.

Only the slave controller whose address code is the same as the sent address code determines the power required 65 from the power code 57 at step 114 and alters the power supplied to its lamp at step 116.

The master controller may communicate the two part codes (address code and power code) for each lamp every, for example, 30 seconds.

If a lamp is replaced before its normal end of life (typically 5000 hours) because of lamp failure (or any other reason) and a new lamp is connected to the slave controller, then the power-time characteristic for the lamp is reset in the master controller by resetting the timer for that slave controller to zero (or keeping a record of the new starting time of the lamp if a single timer 72 is used). All subsequent communication with the replacement lamp is done on this new time.

In practical terms, the resetting of the time for a replacement lamp may be achieved by:

a) placing the master controller in "reset-time mode" by pressing a push button on the master controller, b) displaying the slave controller address on the display (for example 00-99), and c) pressing a reset-time push button to effect the reset.

Figure 10:
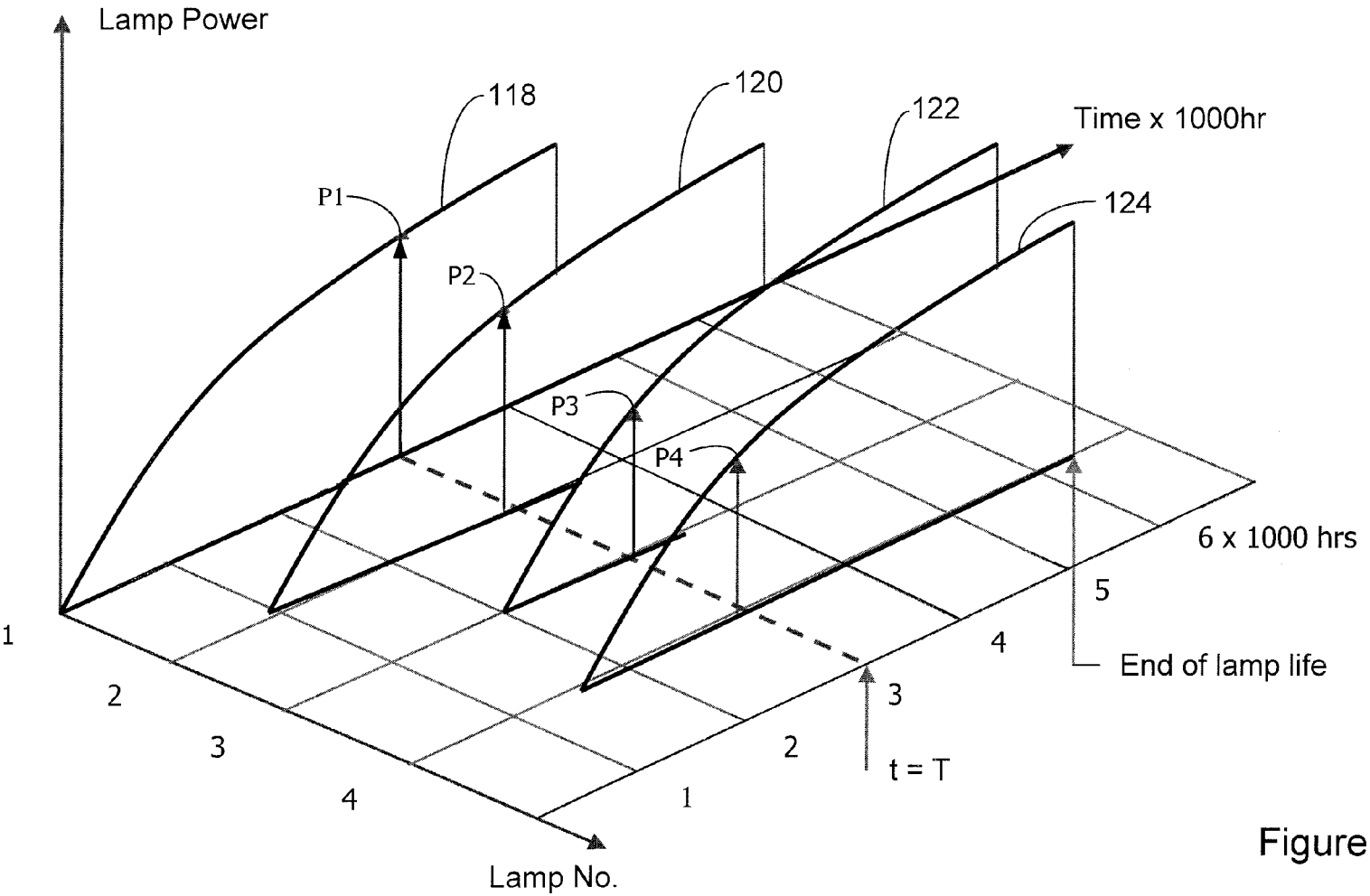
FIG. 10 is a graph showing power-time characteristics for operating lamps which have different starting times.

FIG. 10 shows graphically the operation of lamps 100 (lamp no. 1), 102 (lamp no. 2), 104 (lamp no. 3) and 106 (lamp no. 4) having different starting times (for example, because lamps 102, 104 and 106 have replaced other lamps which have burnt out). In this example, lamp 100 is started at time=0, lamp 102 at time=1000 hours, lamp 104 at time=2000 hours and lamp 106 at time=1600 hours. As shown in the graph, the power-time characteristic 118, 120, 122 and 124 for lamps 100, 102, 104 and 106 effectively start at the respective lamp's starting time.

To operate the lamps at time=T (shown in the graph of FIG. 10 as 3000 hours), power codes 57 representing power P1, P2, P3 and P4 are transmitted from the master to the slave controllers with the respective address code of lamps 100, 102, 104 and 106. This allows the lamps, despite their different operating times, to be operated at a substantially constant luminous flux output.

It is to be understood that various alterations, additions and/or modifications may be made to the parts previously described without departing from the ambit of the present invention, and that, in the light of the above teachings, the present invention may be implemented in software, firmware and/or hardware in a variety of manners as would be understood by the skilled person.

Although the invention has been described in terms of particular embodiments and applications, one of ordinary skill in the art, in light of this teaching, can generate additional embodiments and modifications without departing from the spirit of or exceeding the scope of the claimed invention. Accordingly, it is to be understood that the drawings and descriptions herein are proffered by way of example to facilitate comprehension of the invention and should not be construed to limit the scope thereof.

What is claimed is:

1. A method for operating one or more high intensity discharge (HID) lamps of a particular type and rating, and having a defined operating life, at a predetermined substantially constant luminous flux output, the method including the steps of:

(i) using a test lamp of a similar type and rating to the HID lamps to develop a power-time characteristic that defines the power required at different times in the operating life of the HID lamps to operate the HID lamps at the predetermined luminous flux output, and (ii) operating the HID lamps in accordance with the power-time characteristic, wherein using a test lamp to develop a power-time characteristic includes the steps of:

(a) at a plurality of different times in the operating life of the test lamp:

(i) measuring a luminous flux output from the test lamp, and (b) if the luminous flux output differs from the predetermined luminous flux, (ii) altering power to the test lamp until its luminous flux output equals the predetermined luminous flux, and (iii) recording the time of alteration and the amount of power required at that time, whereby to develop the power-time characteristic.

2. A method as claimed in claim 1 wherein operating the HID lamps includes the step of:

(a) at a plurality of different times in the operating life of the HID lamps (i) communicating a power corresponding to that time in the power-time characteristic to controllers of the HID lamps.

3. A method as claimed in claim 1, wherein altering power to the test lamp involves increasing or decreasing current to the test lamp and recording the amount of power required involves recording the amount of current required.

4. A method as claimed in claim 1 wherein recording the amount of power required involves recording a code representing the amount.

5. A method as claimed in claim 1 wherein operating the HID lamps includes the steps of:

(a) at a plurality of different times in the operating life of the HID lamps (i) altering power to the HID lamps so that they operate at a power corresponding to that time in the power-time characteristic.

6. A method as claimed in claim 5 wherein altering the power to the HID lamps involves increasing or decreasing current to each lamp.

7. A method as claimed in claim 2 wherein communicating a power involves communicating a code representing an amount of power.

8. A method as claimed in claim 2 wherein communicating a power involves communicating a current.

9. A method as claimed in claim 7 further including the step of:

(i) determining the amount of power from the code.

10. A system for operating one or more high intensity discharge (HID) lamps of a particular type and rating, and having a defined operating life, at a predetermined substantially constant luminous flux output, the system including:

(a) a slave controller for each HID lamp, each slave controller including:

(i) a power control unit for electrical connection between a power supply and the lamp, for varying the amount of power supplied to the lamp, and (ii) a receiver for receiving communications to the slave controller, and (b) a master controller including:

(i) a timer for recording the amount of time that the HID lamps have been operating, and (ii) a transmitter for transmitting communications to the slave controller, wherein the master controller communicates a power to the slave controllers at a plurality of different times in the operating life of the HID lamps, the power determined according to a power-time characteristic developed using a test lamp of a similar type and rating to the HID lamps, the power-time characteristic for operating HID lamps of that type and rating at the predetermined luminous flux output.

11. A system as claimed in claim 10 wherein each power control unit includes (i) a primary ballast to provide a primary current to the lamp, and (ii) a current injector for injecting a secondary current to the lamp in order to alter the amount of power supplied to the lamp.

12. A system as claimed in claim 10 wherein the master controller includes (i) a memory storing the power-time characteristic, and (ii) a microprocessor for determining the power required at a given time from the power-time characteristic.

13. A system as claimed in claim 10 wherein the master controller includes (i) a memory storing the power-time characteristic as codes indicating the power required at specific operating times, and (ii) a microprocessor for determining the code corresponding to a given time from the power-time characteristic.

14. A system as claimed in claim 13 wherein the slave controller includes:

(i) a memory storing the amount of power corresponding to codes in the power-time characteristic, and (ii) a microprocessor for determining the power required from a code.

* * * * *